US011390074B2

(12) United States Patent
Kusunoki et al.

(10) Patent No.: US 11,390,074 B2
(45) Date of Patent: Jul. 19, 2022

(54) LIQUID EJECTION HEAD AND LIQUID EJECTION APPARATUS

(71) Applicant: TOSHIBA TEC KABUSHIKI KAISHA, Tokyo (JP)

(72) Inventors: Ryutaro Kusunoki, Mishima Shizuoka (JP); Mengfei Wong, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 38 days.

(21) Appl. No.: 16/921,853

(22) Filed: Jul. 6, 2020

(65) Prior Publication Data

US 2021/0060936 A1 Mar. 4, 2021

(30) Foreign Application Priority Data

Sep. 4, 2019 (JP) ..... JP2019-161233

(51) Int. Cl.
*B41J 2/045* (2006.01)

(52) U.S. Cl.
CPC ..... *B41J 2/04588* (2013.01); *B41J 2/04513* (2013.01); *B41J 2/04541* (2013.01); *B41J 2/04581* (2013.01); *B41J 2/04596* (2013.01)

(58) Field of Classification Search
CPC ..... B41J 2/04595
See application file for complete search history.

(56) References Cited

U.S. PATENT DOCUMENTS

| | | | | |
|---|---|---|---|---|
| 10,137,686 | B2 | 11/2018 | Kusunoki et al. | |
| 2012/0306954 | A1* | 12/2012 | Nishikawa | B41J 2/04516 347/11 |
| 2013/0271519 | A1 | 10/2013 | Kubo et al. | |
| 2016/0355014 | A1* | 12/2016 | Kusunoki | B41J 2/14201 |
| 2017/0144435 | A1* | 5/2017 | Kondo | B41J 2/04586 |
| 2018/0072055 | A1 | 3/2018 | Kiji | |
| 2018/0207932 | A1* | 7/2018 | Kusunoki | B41J 2/04596 |
| 2018/0264810 | A1* | 9/2018 | Harada | B41J 2/04581 |

FOREIGN PATENT DOCUMENTS

EP 3127704 A1 2/2017

OTHER PUBLICATIONS

Extended European Search Report dated Jan. 25, 2021, mailed in counterpart European Application No. 20190155.0, 5 pages.

* cited by examiner

*Primary Examiner* — Shelby L Fidler
(74) *Attorney, Agent, or Firm* — Kim & Stewart LLP

(57) ABSTRACT

According to one embodiment, an actuator of a liquid ejection head is supplied with a drive signal including a first waveform and at least one second waveform. First waveform includes a first change from a first voltage to a second voltage, and a second change from the second voltage to a third voltage less than the first voltage. A second waveform begins after a time equal to one half of the natural oscillation period of liquid in a pressure chamber of the liquid ejection head. The second waveform includes a change from the third voltage to the second voltage and a change from second voltage to the third voltage after a time less than one half of the natural oscillation period.

18 Claims, 7 Drawing Sheets

LIQUID EJECTION HEAD AND LIQUID EJECTION APPARATUS

This application is based upon and claims the benefit of priority from Japanese Patent Application No. 2019-161233, filed on Sep. 4, 2019, the entire contents of which are incorporated herein by reference.

FIELD

Embodiments described herein relate generally to a liquid ejection head and a liquid ejection apparatus.

BACKGROUND

Inkjet heads that eject liquid from nozzles are known. Inkjet heads are also sometimes referred to as a liquid ejection heads. Inkjet recording apparatuses in which such inkjet heads are mounted are also known. Inkjet recording apparatuses are examples of a liquid ejection apparatus. One liquid jet head is known that ejects a liquid by applying a drive voltage to an actuator. In such an liquid jet head (or inkjet head), when the driving voltage is high, the lifetime of the actuator(s) tends to decrease.

DETAILED DESCRIPTION

In general, according to one embodiment, a liquid ejection head comprises a pressure chamber, an actuator configured to change a pressure of a liquid in the pressure chamber in accordance with a drive signal, and a drive circuit configured to supply the drive signal to the actuator to cause the liquid to be discharged via a nozzle fluidly connected to the pressure chamber. The drive signal comprises a first waveform and N second waveforms after the first waveform, where N is greater than or equal to one. The first waveform comprises a first change from a first voltage to a second voltage that reduces the pressure of the liquid in the pressure chamber; and a second change after the first change. The second change is from the second voltage to a third voltage that is between the first voltage and the second voltage and occurs after the first change by one half of a natural oscillation period of the liquid in the pressure chamber. The N second waveforms comprises a third change from the third voltage to the second voltage that reduces the pressure of the liquid in the pressure chamber and a fourth change after the third change. The fourth change is from the second voltage to the third voltage and occurs after the third change by a time period that is less than one half of the natural oscillation period of the liquid in the pressure chamber.

Hereinafter, an inkjet head according to an embodiment and an inkjet recording apparatus equipped with the inkjet head according to an embodiment will be described with reference to the drawings. Note, in general, the drawings are not to scale. In addition, for the sake of description, various aspects present in an implemented embodiment may be omitted from certain drawings.

Figure 1:
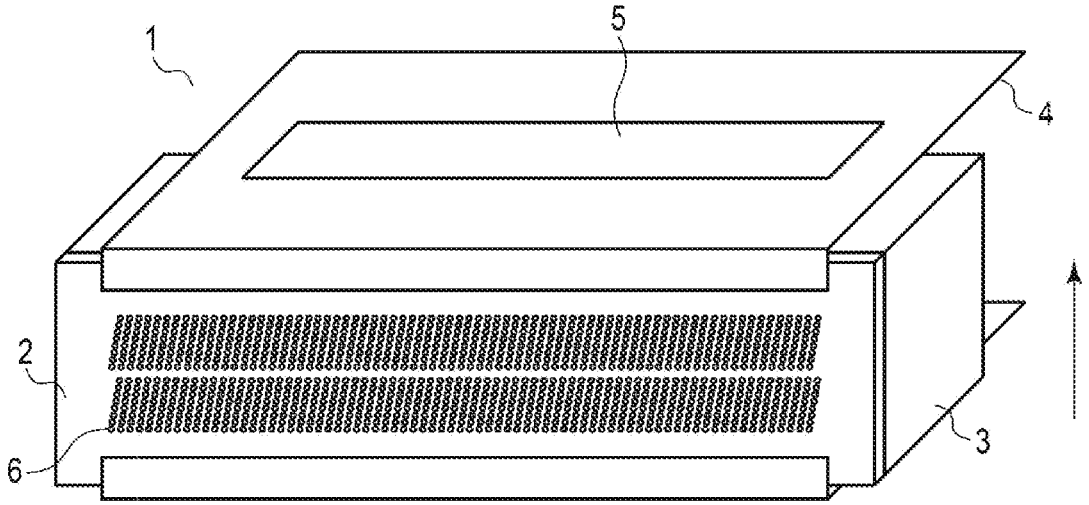
FIG. 1 is a perspective view illustrating aspects of an inkjet head according to an embodiment.

FIG. 1 is a perspective view illustrating an appearance of an inkjet head 1 according to an embodiment. The inkjet head 1 comprises a flow path substrate 2, an ink supply unit 3, a flexible wiring substrate 4, and a drive circuit 5. Note that the inkjet head 1 is an example of a liquid eject head.

In the flow path substrate 2, actuators 6 provided with nozzles 17 (shown in FIG. 3, which will be described later) for ejecting ink are arranged in an array shape. The respective nozzles 17 do not overlap with each other in the printing direction, and are arranged at equal intervals with respect to a direction perpendicular to the printing direction. Each actuator 6 is electrically connected to the drive circuit 5 via the flexible wiring substrate 4. The drive circuit 5 is electrically connected to a control circuit that performs printing control. The flow path substrate 2 and the flexible wiring substrate 4 are joined and electrically connected to each other by an anisotropic conductive film (ACF). The flexible wiring substrate 4 and the drive circuit 5 are joined and electrically connected to each other as, for example, a Chip-on-Flex (COF).

The ink supply unit 3 is joined to the flow path substrate 2 by, for example, an epoxy-based adhesive. The ink supply unit 3 has an ink supply port for connecting to a tube or the like, and supplies an ink fed to the ink supply port to the flow path substrate 2. The pressure of the ink supplied to the ink supply port is preferably about 1000 Pa (1 kPa) lower than the atmospheric pressure. The ink fed in from the ink supply port and fills the inside of a pressure chamber 18 and the nozzle 17 if the pressure of the ink in the pressure chamber 18 is maintained at a pressure that is about 1000 Pa lower than the atmospheric pressure while waiting for an ejection of the ink to occur. The ink supply unit 3 can be considered an example of a liquid supply apparatus that supplies ink to the pressure chamber 18.

The drive circuit 5 applies an electric signal to the actuator 6. The electric signal is also referred to as a drive signal. When the drive circuit 5 applies a drive signal to the actuator 6, the actuator 6 changes the volume of (or otherwise pressure inside) the pressure chamber 18 inside the flow path substrate 2. Accordingly, the ink in the pressure chamber 18 generates a pressure oscillation. Due to the pressure oscillation, the ink is ejected from the nozzle 17 provided in the actuator 6 in the normal direction of the surface of the flow path substrate 2. Note that the inkjet head 1 can realize gradations in color (tone representation) by changing the number or size of ink droplets that land at a position corresponding to one pixel. The inkjet head 1 changes the amount of ink droplets that land on one pixel by changing the number of times the ink is ejected to form a particular pixel. As described above, the drive circuit 5 can be considered an example of an application unit that applies the drive signal to the actuator.

Figure 2:
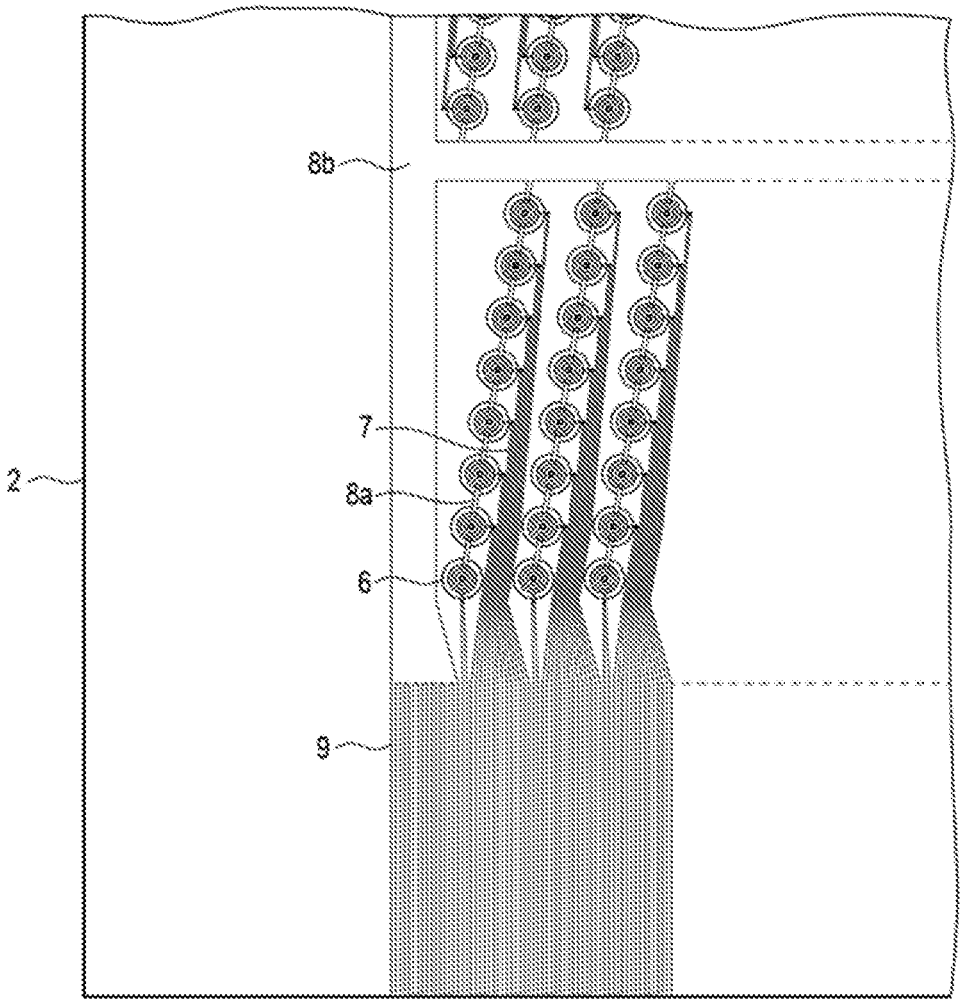
FIG. 2 is a plan view illustrating aspects of a flow path substrate.

FIG. 2 is a plan view illustrating details of the flow path substrate 2. In FIG. 2, the repeated portions having the same pattern are omitted. In the flow path substrate 2, a number of actuators 6, a plurality of individual electrodes 7, a common electrode 8*a*, a common electrode 8*b*, and a large number of mounting pads 9 are formed. Note that both the common electrode 8*a* and the common electrode 8*b* may be more simply referred to as a common electrode 8 in certain contexts when it unnecessary to distinguish between the two.

The individual electrode 7 electrically connects each actuator 6 to a mounting pad 9. The individual electrodes 7 are electrically independent of each other. The common electrode 8*b* is electrically connected to the mounting pads 9 on the end. The common electrode 8*a* branches from the common electrode 8*b* and is electrically connected to the plurality of actuators 6. The common electrode 8*a* and the common electrode 8*b* are electrically shared by a plurality of actuators 6.

The mounting pads 9 are electrically connected to the drive circuit 5 via a large number of wiring patterns formed on the flexible wiring substrate 4. An anisotropic conductive film may be used as a connection between the mounting pads 9 and the flexible wiring substrate 4. In addition, each mounting pad 9 may be connected to the drive circuit 5 by a method such as wire bonding or the like.

Figure 3:
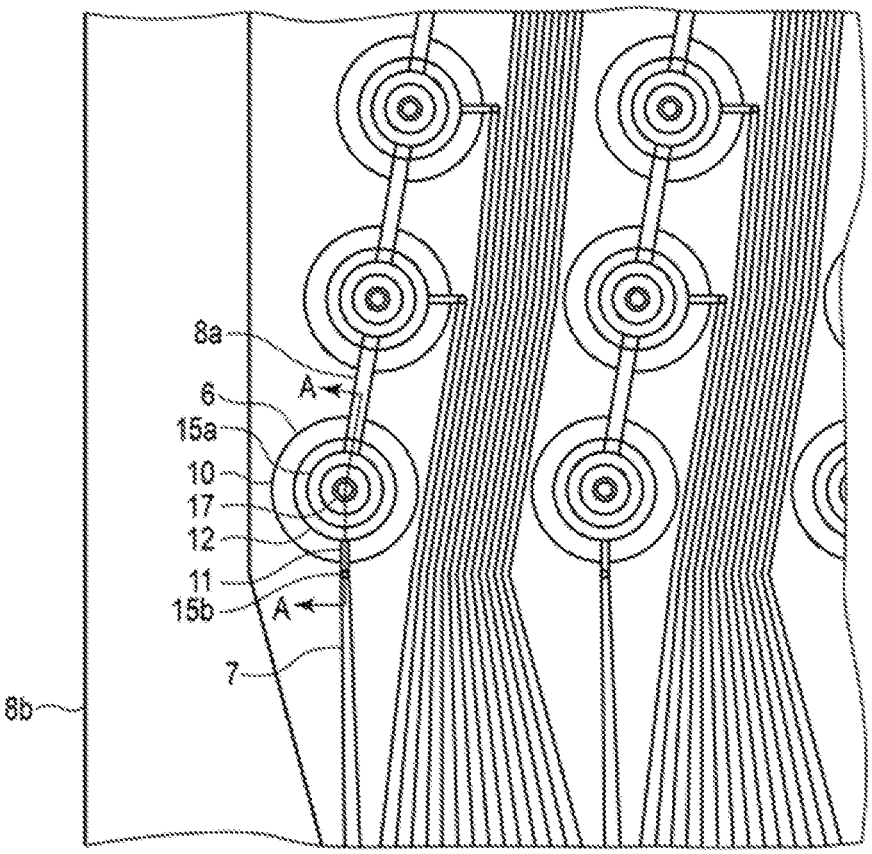
FIG. 3 is a plan view illustrating aspects of an actuator and a surroundings thereof.
Figure 4:
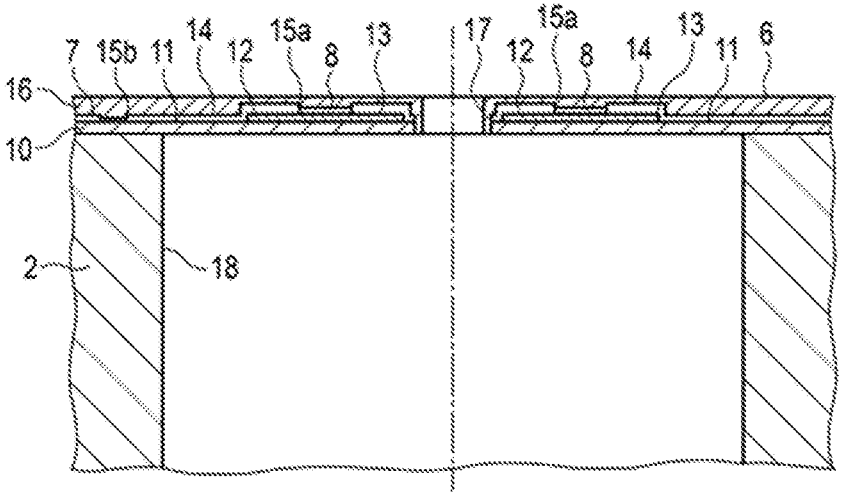
FIG. 4 is a cross-sectional view taken along line A-A in FIG. 3.

FIG. 3 is a plan view illustrating details of the actuator 6 and the surroundings thereof. FIG. 4 is a cross-sectional view taken along the line A-A line in FIG. 3. The actuator 6 includes a common electrode 8*a*, a vibration plate 10, a lower electrode 11, a piezoelectric body 12, an upper electrode 13, an insulating layer 14, a protective layer 16, and a nozzle 17. Each lower electrode 11 is electrically connected to an individual electrode 7.

The flow path substrate 2 is formed of, for example, a single-crystal silicon wafer having a thickness of 500 μm. The pressure chamber 18 is formed inside the flow path substrate 2. The diameter of the pressure chamber 18 is, for example, 200 μm. The pressure chamber 18 is formed, for example, by drilling a hole using a dry etching technique from the lower surface of the flow path substrate 2.

The vibration plate 10 is formed integrally with the flow path substrate 2 so as to cover the upper surface of the pressure chamber 18. The vibration plate 10 is silicon dioxide formed by heating the flow path substrate 2 at a high temperature prior to formation of the pressure chamber 18. The vibration plate 10 has a through-hole having a diameter greater than that of the nozzle 17. The through-hole is aligned concentrically with the nozzle 17. The thickness of the vibration plate 10 is, for example, 4 μm.

On the vibration plate 10, the lower electrode 11, the piezoelectric body 12, and the upper electrode 13 are formed in a donut shape (annular shape) around the nozzle 17. The inner diameter is 30 μm as an example. The outer shape is, for example, 140 μm. As an example, the lower electrode 11 and the upper electrode 13 are formed by depositing platinum or the like by a sputtering method or similar method. The piezoelectric body 12 is formed by depositing PZT ($Pb(Zr,Ti)O_3$) (lead zirconate titanate) or the like by a sputtering method, a sol-gel method, or the like. The thickness of the upper electrode 13 and the thickness of the lower electrode 11 are, for example, 0.1 μm to 0.2 μm. The thickness of the PZT is, for example, 2 μm.

When a positive voltage is applied to the actuator 6 and an electric field is generated in the thickness direction of the piezoelectric body 12, deformation of the d31 mode occurs in the piezoelectric body 12. That is, the piezoelectric body 12 contracts in a direction perpendicular to its own thickness direction when a positive voltage is applied to the actuator 6. Due to this contraction, compressive stress is generated in the vibration plate 10 and the protective layer 16. At this time, since the Young's modulus of the vibration plate 10 is larger than that of the protective layer 16, the compressive force generated in the vibration plate 10 exceeds that generated in the protective layer 16. Thus, when a positive voltage is applied, the actuator 16 curves (bows) in the direction of the pressure chamber 18. Thereby, the volume of the pressure chamber 18 is made smaller than is the case when no voltage is applied to the actuator 6. That is, as the value of the voltage of the drive signal applied to the actuator 6 becomes larger, the volume of the pressure chamber 18 becomes smaller.

The insulating layer 14 is formed on an upper surface of the upper electrode 13. A contact hole 15*a* and a contact hole 15*b* are formed in the insulating layer 14. The contact hole 15*a* is a donut-shaped opening, and the upper electrode 13 and the common electrode 8 are electrically connected to each other via this opening. The contact hole 15*b* is a circular opening, and the lower electrode 11 and the individual electrode 7 are electrically connected to each other via this opening. The insulating layer 14 is, as an example, silicon dioxide film, for example formed by a TEOS (tetraethoxysilane) CVD (chemical vapor deposition) method. The thickness of the insulating layer 14 is 0.5 μm as an example. The insulating layer 14 prevents the common electrode 8 and the lower electrode 11 from coming into electrical contact with each other in the outer periphery of the piezoelectric body 12.

On the upper surface of the insulating layer 14, the individual electrodes 7, the common electrode 8 and the mounting pads 9 are formed. The individual electrode 7 is connected to the lower electrode 11, and the common electrode 8 is connected to the upper electrode 13 via the contact holes 15*b* and 15*a*, respectively. In addition, in other examples, the individual electrode 7 may be connected to the upper electrode 13 and the common electrode 8 may be connected to the lower electrode 11. The individual electrodes 7, the common electrode 8, and the mounting pads 9 are formed by forming gold film by a sputtering method as an example. The thickness of an individual electrode 7, the common electrode 8, and a mounting pad 9 is, for example, 0.1 μm to 0.5 μm.

The protective layer 16 is formed on the individual electrodes 7, the common electrode 8 and the insulating layer 14. As an example, the protective layer 16 is formed by depositing a photosensitive polyimide material by a spin coating method. The protective layer 16 has a thickness of 4 μm, for example. In the protective layer 16, the nozzle 17 communicating with the pressure chamber 18 is open.

The nozzle 17 is formed by, for example, exposing and then developing the photosensitive polyimide material forming the protective layer 16 in a photolithographic technique. The diameter of the nozzle 17 is, for example, 20 μm. The length of the nozzle 17 is determined by the sum of the thickness of the vibration plate 10 and the thickness of the protection layer 16. The length of the nozzle 17 is, for example, 8 μm.

Figure 5:
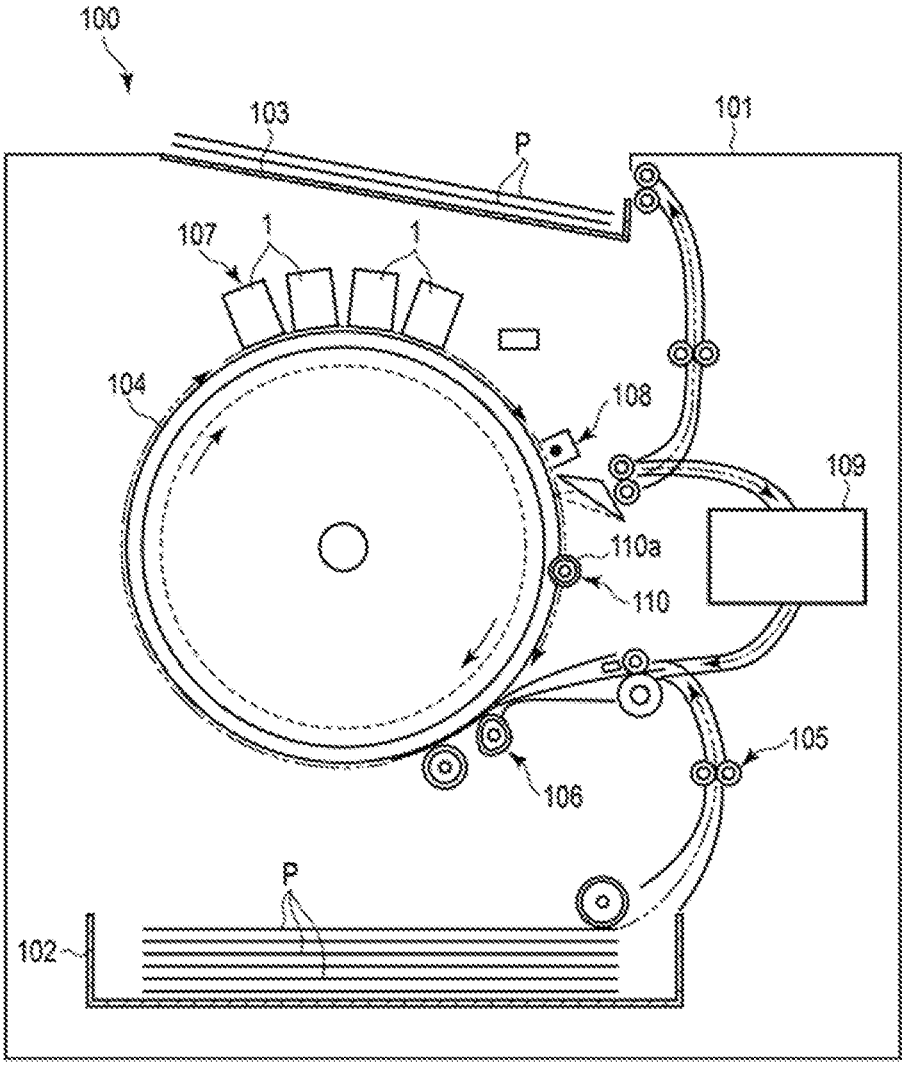
FIG. 5 is a schematic view illustrating aspects of an inkjet recording apparatus according to an embodiment.

Next, an inkjet recording apparatus 100 having an inkjet head 1 will be described. FIG. 5 is a schematic diagram for describing an example of the inkjet recording apparatus 100. The inkjet recording apparatus 100 can also be referred to as an inkjet printer. Note that the inkjet recording apparatus 100 may also or instead be a device such as a copying machine. The inkjet recording apparatus 100 is one example of a liquid ejection apparatus.

The inkjet recording apparatus 100 performs various types of processing for image formation while transporting recording sheets P (recording media), for example, past the inkjet head 1. The inkjet recording apparatus 100 in this example comprises a housing 101, a sheet feeding cassette 102, a sheet discharge tray 103, a holding roller (drum) 104, a conveyance device 105, a holding device 106, an image forming apparatus 107, a static elimination peeling device 108, a reversing device 109, and a cleaning device 110.

The housing 101 contains the various components that make up the inkjet recording apparatus 100. The sheet feeding cassette 102 is in the housing 101 and can accommodate a number of recording sheets P. The sheet discharge tray 103 is at the top of the housing 101. The sheet discharge tray 103 is a destination of the recording sheet P after an image has been formed thereon by the inkjet recording apparatus 100.

The holding roller 104 has a frame of a cylindrical conductor and a thin insulating layer formed on a surface of the frame. The frame is grounded (ground connected). The holding roller 104 conveys a recording sheet P by rotating while holding the recording sheet P on the surface thereof.

The conveyance device 105 has a plurality of guides and a plurality of conveyance rollers disposed along a conveyance path of the recording sheet P. The conveyance roller can be driven by a motor to rotate. The conveyance device 105 conveys the recording sheet P from the sheet feeding cassette 102 to the holding roller 104 to carry the recording sheet P past the inkjet head(s) 1 and then on to the sheet discharge tray 103.

The holding device 106 directs the recording sheet P fed from the sheet feeding cassette 102 by the conveyance device 105 onto the surface (outer peripheral surface) of the holding roller 104. The holding device 106 charges the recording sheet P and causes the recording sheet P to be attracted to the holding roller 104 by electrostatic force once the recording sheet P is pressed against the holding roller 104.

The image forming apparatus 107 forms an image on a recording sheet P while it is being held on a surface of the holding roller 104. The image forming apparatus 107 in this example has a plurality of inkjet heads 1 facing the surface of the holding roller 104. The inkjet heads 1 form an image on the surface of the recording sheet P by ejecting inks of four different colors (cyan, magenta, yellow, and black) onto the recording sheet P, for example.

The static elimination peeling device 108 detaches the recording sheet P from the holding roller 104 by removing static electricity from the recording sheet P after image formation. The static elimination peeling device 108 supplies charge to neutralize existing charges on the recording sheet P and inserts a wedge between the recording sheet P and the holding roller 104. This causes the recording sheet P to peel off the holding roller 104. The conveyance device 105 then conveys the recording sheet P that has been detached from the holding roller 104 to the sheet discharge tray 103 or the reversing device 109.

The reversing device 109 reverses the front and back sides of the recording sheet P and feeds a reversed recording sheet P back onto the surface of the holding roller 104 again. The reversing device 109 inverts the recording sheet P by, for example, transporting the recording sheet P along a predetermined reversing path that causes the recording sheet P to reverse in the front-back direction.

The cleaning device 110 cleans the holding roller 104. The cleaning device 110 is arranged downstream of the static elimination peeling device 108 in the direction of rotation of the holding roller 104. The cleaning device 110 causes a cleaning member 110*a* to rub on the surface of the rotating holding roller 104 to clean the surface of the rotating holding roller 104.

Figure 6:
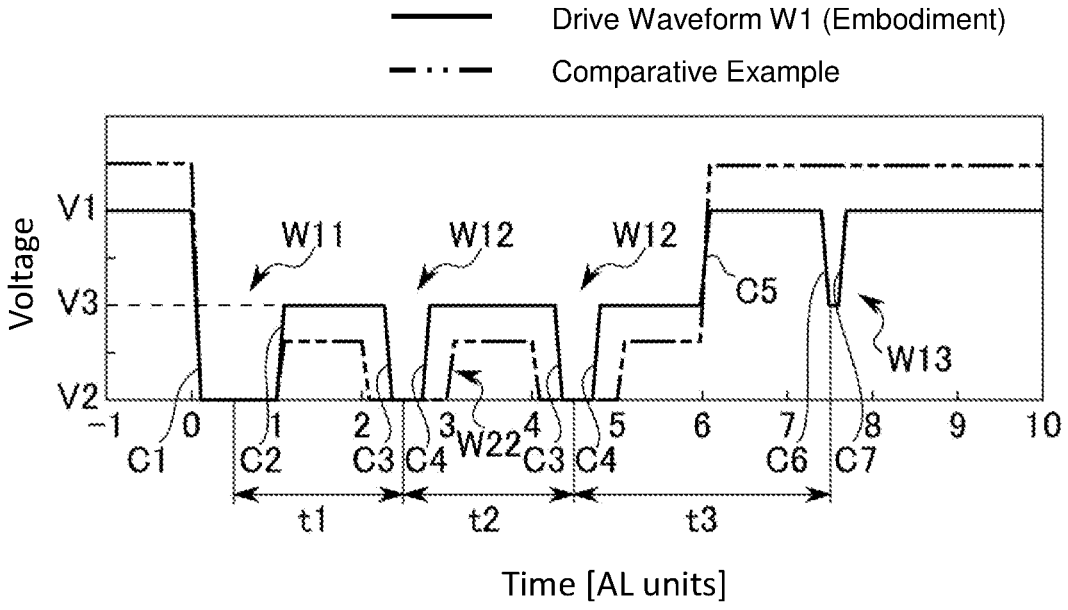
FIG. 6 is a graph illustrating a waveform of a drive signal.

Hereinafter, an operation of the inkjet head 1 according to an embodiment will be described. FIG. 6 is a graph illustrating a waveform of a drive signal applied to the actuator 6 by the drive circuit 5. FIG. 6 shows a drive waveform W1 and a drive waveform W12. The drive waveform W1 is one example of a waveform of the drive signal according to an embodiment. The drive waveform W12 is an example of a waveform of the drive signal in the related art (comparative example). In the FIG. 6, the vertical axis represents the voltage, and the horizontal axis represents time. Note that the length of one graduation on the horizontal axis is equal to 1 acoustic length (AL). Here, 1 AL unit is equal to one half of the natural vibration period (that is, the period at the main acoustic resonance frequency) of the ink in the pressure chamber 18.

The drive waveform W1 include one waveform W11, (n−1) waveforms W12, and one waveform W13. Here, n represents the number of times which the ink is ejected in a sequence and is an integer greater than or equal to 1. Note that the drive waveform W1 illustrated in FIG. 6 is the drive waveform W1 for a case where n is 3.

The waveform W11 is a pulse waveform including a change C1 and a change C2. The pulse width of the waveform W11 is preferably equal to one acoustic length (1 AL unit). The pulse width of waveform W11 is the time from the start of the change C1 to the start of the change C2. When the pulse width of waveform W1 is 1 AL, the ink ejection force of the ink is increased. Note that waveform W11 can be considered an example of a first waveform.

The change C1 is a change from voltage V1 to voltage V2. The drive waveform W1 maintains the voltage V1 in the standby state before the change C1. The V2 is a voltage lower than the voltage V1. The voltage V2 is preferably 0V, but may be a slightly negative value, that is, have a polarity opposite to the voltage V1. However, if the negative value is too large, the polarization direction of the piezoelectric body 12 can be reversed with respect to the standby state, and the desired operation cannot be obtained. Therefore, the voltage V2 is preferably 0V. Due to the change C1, the volume of the pressure chamber 18 expands. As a result, the pressure of the ink in the pressure chamber 18 decreases.

The change C2 is a change from the voltage V2 to the voltage V3. The voltage V3 is a voltage between the voltage V1 and the voltage V2. That is, the voltage V3 is a voltage that is smaller than the voltage V1 and larger than the voltage V2. The voltage V3 is preferably a voltage that is one-half of the voltage V1. The change C2 causes the volume of the pressure chamber 18 to contract. As a result, the pressure of the ink in the pressure chamber 18 increases, and the ink is ejected from the nozzle 17.

The waveform W12 is a pulse waveform that after the waveform W11. The waveform W12 includes a change C3 and a change C4. The pulse width of the waveform W12 is shorter than 1 AL. The pulse width of the waveform W12 is a time from the start of the change C3 to the start of the change C4. Note that the pulse width of the waveform W22 in the drive waveform W2, which is the comparative example, is 1 AL. That is, the pulse width of the waveform W12 is shorter than the pulse width in the conventional waveform. Further, when the pulse width of the waveform W12 is shorter than 1 AL, the voltage V3 can be made larger than that in the related art while maintaining the ejection force. If the voltage V3 can be increased, the voltage V1 can be reduced while maintaining the ejection force. That is, by setting the pulse width of the waveform W12 to be shorter than 1 AL, the voltage V1 can be made smaller than that in the conventional art. Note that when the voltage V3 is too low, it is necessary to increase the voltage V1, and when the voltage V3 is too high, a residual vibration increases.

Therefore, it is preferable that the voltage V3 is about one-half of the voltage V1. Note that the waveform W12 is one example of a second waveform. The change C3 is a change from the voltage V3 to the voltage V2. The change C3 expands the volume of the pressure chamber 18. As a result, the pressure of the ink in the pressure chamber 18 decreases.

The change C4 is a change from the voltage V2 to the voltage V3. The change C4 causes the volume of the pressure chamber 18 to contract. As a result, the pressure of the ink in the pressure chamber 18 increases, and the ink ejects from the nozzle 17.

The time t1 from the middle point between the start of the change C1 and the start of the change C2 to the middle point between the start of the change C3 in the first waveform W12 and the start of the change C4 is preferably 2AL in terms of the ejection power. In addition, the voltage of the drive waveform W1 from the end of the change C2 to the start of the change C3 is the voltage V3. The time t2 from the middle point between the start of the change C3 in the (m−1)-th waveform W12 and the start of the change C4 to the middle between the start of the change C3 in the m-th waveform W12 and the start of the change C4 is preferably 2AL. Note that here m is an arbitrary integer equal to or greater than 2 and equal to or less than n. The voltage of the drive waveform W1 from the end of the change C4 in the (m−1)-th waveform W12 to the start of the change C2 in the m-th waveform W12 is voltage V3.

The waveform W13 is a pulse waveform for cancelling the residual vibration. That is, the waveform W13 is one example of a cancellation pulse for reducing the residual vibration.

The waveform W13 is applied after the last ejection waveform. Note that the last ejection waveform is the (n−1)-th waveform W12 when n is equal to or greater than 2. If n is 1, then last ejection waveform will be the waveform W11. Note that the pulse width of the waveform W13 is set to be a width such that the residual vibration can be canceled. The drive waveform W1 includes a change C5 between the last ejection waveform and the waveform W13. The voltage of the drive waveform W1 from the end of the change of the last ejection waveform (the change C2 or the change C4 depending on the value of n) to the start of the change C5 is voltage V3. The change C5 is a change from the voltage V3 to the voltage V1. The change C5 causes the volume of the pressure chamber 18 to contract. As a result, the pressure of the ink in the pressure chamber 18 increases.

The waveform W13 includes a change C6 and a change C7. Note that the voltage of the drive waveform V1 from the end of the change C5 to the start of the change C6 is voltage V1. The change C6 is a change from the voltage V1 to the voltage V3. The change C6 expands the volume of the pressure chamber 18. As a result, the pressure of the ink in the pressure chamber 18 decreases. The change C7 is a change from the voltage V3 to the voltage V1. The change C5 causes the volume of the pressure chamber 18 to contract. As a result, the pressure of the ink in the pressure chamber 18 increases.

Note that the time t3 from the middle point between the start of the first change in the last ejected waveform and the start of the second change in the last ejected waveform to the middle point between the start of the change C6 and the start of the change C7 in the waveform W13 is preferably 3 AL. Note that the first change included in the last ejection waveform is the change C1 when n is 1, and the second change included in the last ejection waveform is the change C2 when n is 1. The first change included in the last ejection waveform is the change C3 when n is 2 or more, and the second change included in the last ejection waveform is the change C4 when n is 2 or more.

Figure 7:
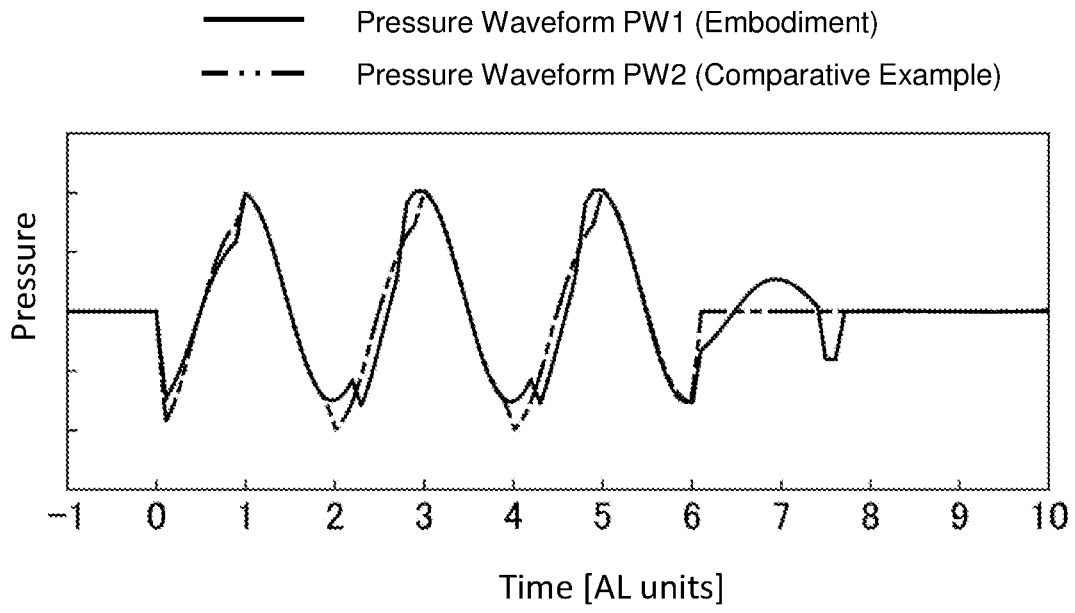
FIG. 7 is a graph illustrating a waveform of a pressure oscillation.

FIG. 7 is a graph illustrating a waveform of the pressure oscillation of the ink in the pressure chamber 18, the pressure oscillation is being generated in accordance with the drive signal. FIG. 7 shows a pressure waveform PW1 and a pressure waveform PW2. The pressure waveform PW1 is one example of a waveform of the pressure oscillation of the ink in the pressure chamber 18 when the drive waveform W1 is applied. The pressure waveform PW2 is one example of a waveform of the pressure oscillation of the ink in the pressure chamber 18 when the drive waveform W2 is applied. In the graph in FIG. 7, the vertical axis represents the pressure (in arbitrary units), and the horizontal axis represents time. Note that the length of one graduation on the horizontal axis is 1 AL.

As shown in FIG. 7, for the pressure waveform PW1 and the pressure waveform PW2, the amplitudes are approximately equal to each other. Therefore, it can be seen that the ink can be ejected with the same ejection force when the drive waveform W1 is applied to the actuator 6 as when the drive waveform W2 is applied.

As shown in FIG. 7, it can be seen that the residual vibration is sufficiently canceled by the waveform W13 (see FIG. 6) in the pressure waveform PW1.

The above-described embodiments may also be modified in various ways. The inkjet recording apparatus 100 of an embodiment is an inkjet printer that forms a two dimensional image by ejecting ink onto the recording sheet P. However, the inkjet recording apparatus 100 according to the present disclosure is not limited thereto. The inkjet recording apparatus 100 may be, for example, a 3D printer, an industrial manufacturing machine, a medical machine, or the like. In the case where the inkjet recording apparatus 100 is a 3D printer, an industrial manufacturing machine, or a medical machine, the inkjet recording apparatus 100 may form a three dimensional object by ejecting a material and/or a binder for solidifying a material from the inkjet head rather than simple ink.

The inkjet recording apparatus 100 of the example embodiment includes four inkjet heads 1, and the color of ink used by each inkjet head 1 is cyan, magenta, yellow, or black. However, the number of inkjet heads 1 included in the inkjet recording apparatus 100 is not limited to four and the number of inkjet heads 1 may be any number of one or more. Further, the color, the characteristics, and the like of the ink used by each inkjet head 1 are not limited. For example, the inkjet head 1 can eject transparent glossy ink, ink that develops color when irradiated with light (e.g., infrared rays, ultraviolet rays) or the like, or other special inks. In some examples, the inkjet head 1 may eject a liquid other than ink, such as in dispensing of liquids in a medical research apparatus. Note that the liquid ejected by the inkjet head 1 may be a liquid solution or a suspension. Examples of a liquid other than ink that can be ejected by inkjet head 1 include a liquid including conductive particles for forming a wiring pattern of a printed wiring board, a binder material for applications such as an artificial tissue or an organ growth, a binder material such as an adhesive, a wax, a liquid resin, or the like for 3D printing applications.

In addition to the above-described embodiments, the inkjet head 1 may have a structure in which a vibration plate (diaphragm or the like) is deformed by piezoelectricity to eject ink, or a structure in which ink is ejected from a nozzle by using heat energy, such as generated by a local heater. In these cases, the diaphragm, the heater, or the like may be referred to as actuators that change the pressure of the ink in the pressure chamber.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejection head, comprising:

a pressure chamber;

an actuator configured to change a pressure of a liquid in the pressure chamber in accordance with a drive signal;

a drive circuit configured to supply the drive signal to the actuator to cause the liquid to be discharged via a nozzle fluidly connected to the pressure chamber, wherein the drive signal comprises a first waveform and N second waveforms after the first waveform, where N is greater than or equal to one, the first waveform comprises:

a first change from a first voltage to a second voltage that reduces the pressure of the liquid in the pressure chamber; and a second change after the first change, the second change being from the second voltage to a third voltage that is between the first voltage and the second voltage and occurring after the first change by one half of a natural oscillation period of the liquid in the pressure chamber, the N second waveforms comprise:

a third change from the third voltage to the second voltage that reduces the pressure of the liquid in the pressure chamber; and a fourth change after the third change, the fourth change being from the second voltage to the third voltage and occurring after the third change by a time period that is less than one half of the natural oscillation period of the liquid in the pressure chamber, and the time from a midpoint between the first and second changes to a midpoint between the third and fourth changes of a first one of the N second waveforms is equal to the natural oscillation period.

2. The liquid ejection head according to claim 1, wherein the drive signal further comprises a cancellation pulse after the N second waveforms.

3. The liquid ejection head according to claim 2, wherein N is equal to two or more, and the time from a midpoint between the third and fourth changes in the (N−1)th second waveform to a midpoint between the third and fourth changes in the Nth second waveform is equal to the natural oscillation period.

4. The liquid ejection head according to claim 2, wherein the third voltage is one half of the first voltage.

5. The liquid ejection head according to claim 1, wherein N is equal to two or more, and the time from a midpoint between the third and fourth changes in the (N−1)th second waveform to a midpoint between the third and fourth changes in the Nth second waveform is equal to the natural oscillation period.

6. The liquid ejection head according to claim 1, wherein the third voltage is one half of the first voltage.

7. The liquid ejection head according to claim 1, wherein the drive signal returns to the first voltage after a last one of the N second waveforms, and the drive signal further comprises a cancellation pulse after the last one of the N second waveforms, the cancellation pulse comprising a fifth change from the first voltage to the third voltage and sixth change after the fifth change, the sixth change being from the third voltage to the first voltage.

8. The liquid ejection head according to claim 7, wherein the time from a midpoint between the third and fourth changes of the last one of the N second waveforms and a midpoint between the fifth and sixth changes of the cancellation point is longer than the natural oscillation period.

9. The liquid ejection head according to claim 1, wherein the actuator is a piezoelectric actuator.

10. A liquid ejection apparatus, comprising:

a recording media conveyance path;

an imaging unit configured to form an image on a recording medium on the recording media conveyance path using ink, the imaging unit including:

a pressure chamber;

an actuator configured to change a pressure of an ink in the pressure chamber in accordance with a drive signal;

a drive circuit configured to supply the drive signal to the actuator to cause the ink to be discharged as droplets via a nozzle fluidly connected to the pressure chamber, wherein the drive signal comprises a first waveform and N second waveforms after the first waveform, where N is greater than or equal to one, the first waveform comprises:

a first change from a first voltage to a second voltage that reduces the pressure of the ink in the pressure chamber; and a second change after the first change, the second change being from the second voltage to a third voltage that is between the first voltage and the second voltage and occurring after the first change by one half of a natural oscillation period of the ink in the pressure chamber, the N second waveforms comprise:

a third change from the third voltage to the second voltage that reduces the pressure of the ink in the pressure chamber; and a fourth change after the third change, the fourth change being from the second voltage to the third voltage and occurring after the third change by a time period that is less than one half of the natural oscillation period of the ink in the pressure chamber, and the time from a midpoint between the first and second changes to a midpoint between the third and fourth changes of a first one of the N second waveforms is equal to the natural oscillation period.

11. The liquid ejection apparatus according to claim 10, wherein the drive signal further comprises a cancellation pulse after the N second waveforms.

12. The liquid ejection apparatus according to claim 10, wherein N is equal to two or more, and the time from a midpoint between the third and fourth changes in the (N−1)th second waveform to a midpoint between the third and fourth changes in the Nth second waveform is equal to the natural oscillation period.

13. The liquid ejection apparatus according to claim 10, wherein the third voltage is one half of the first voltage.

14. The liquid ejection apparatus according to claim 10, wherein the drive signal returns to the first voltage after a last one of the N second waveforms, and the drive signal further comprises a cancellation pulse after the last one of the N second waveforms, the cancellation pulse comprising a fifth change from the first voltage to the third voltage and sixth change after the fifth change, the sixth change being from the third voltage to the first voltage.

15. The liquid ejection apparatus according to claim 10, wherein the actuator is a piezoelectric actuator.

16. A method of ejecting liquid from a liquid ejection head, the method comprising:

supplying a drive signal to an actuator to cause a liquid in a pressure chamber to be discharged via a nozzle fluidly connected to the pressure chamber, wherein the drive signal comprises a first waveform and N second waveforms after the first waveform, where N is greater than or equal to one, the first waveform comprises:

a first change from a first voltage to a second voltage that reduces the pressure of the liquid in the pressure chamber; and a second change after the first change, the second change being from the second voltage to a third voltage that is between the first voltage and the second voltage and occurring after the first change by one half of a natural oscillation period of the liquid in the pressure chamber, the N second waveforms comprise:

a third change from the third voltage to the second voltage that reduces the pressure of the liquid in the pressure chamber; and a fourth change after the third change, the fourth change being from the second voltage to the third voltage and occurring after the third change by a time period that is less than one half of the natural oscillation period of the liquid in the pressure chamber, and the time from a midpoint between the first and second changes to a midpoint between the third and fourth changes of a first one of the N second waveforms is equal to the natural oscillation period.

17. The method according to claim 16, wherein the drive signal further comprises a cancellation pulse after the N second waveforms.

18. The method according to claim 16, wherein the actuator is a piezoelectric actuator.

* * * * *